United States Patent [19]

Liu

[11] Patent Number: 4,629,125

[45] Date of Patent: Dec. 16, 1986

[54] SPRAY NOZZLE

[76] Inventor: Fuyi Liu, Fl.4-1, No.49-1 Sec.2, Ho-Pin East Road, Taipei, Taiwan

[21] Appl. No.: 644,431

[22] Filed: Aug. 27, 1984

[51] Int. Cl.[4] ..... B05B 1/16

[52] U.S. Cl. ..... 239/443; 239/383

[58] Field of Search ..... 239/380, 381, 383, 443–444

[56] References Cited

U.S. PATENT DOCUMENTS

| | | | |
|---|---|---|---|
| 3,958,756 | 5/1976 | Trenary et al. | 239/383 |
| 4,187,986 | 2/1980 | Petrovic | 239/449 |
| 4,190,207 | 2/1980 | Fienhold et al. | 239/381 |
| 4,219,160 | 8/1980 | Allred, Jr. | 239/447 |

*Primary Examiner*—Joseph F. Peters, Jr.
*Assistant Examiner*—Scott Malpede
*Attorney, Agent, or Firm*—Lowe, Price, LeBlanc, Becker & Shur

[57] ABSTRACT

The instant invention relates to a spray nozzle or showerhead which is operable to selectively discharge a continuously coarse spray, a pulsating spray, a variable combination of the coarse spray and pulsating spray, a continuously fine spray and a variable combination of the fine spray and pulsating spray. The nozzle housing is formed with three separate groups of discharge orifices. A flow directing plate is designed to direct flow through three set of passages to discharge said five types of sprays.

1 Claim, 11 Drawing Figures

SPRAY NOZZLE

BACKGROUND AND SUMMARY OF THE INVENTION

The invention relates to a spray nozzle or showerhead and more particularly to an improved one which is operable to discharge a number of continuous sprays and a pulsating spray and the combination thereof.

Spray nozzles or showerheads which are operable to discharge a continuous spray and/or a pulsating spray are known. A conventional spray nozzle is capable of discharging only a pulsating spray so as to produce a massaging effect, on striking the body of a person using the showerhead, which in most instances is found to be quite stimulating. However, this feature is in some cases undesirable. For example, persons may prefer to have a pulsating spray available at the beginning or end of the shower with a gentle continuous spray available at other times. Other persons are highly sensitive to the pulsating action of the spray and would prefer to have a nonpulsating spray, thus creating a problem in families where some members prefer the pulsating spray while other members do not.

Another conventional spray nozzle, in addition to a showerhead spray, possesses the capability of discharging a continuous or nonpulsating spray and further provides the possibility of a spray which combines both pulsating and nonpulsating streams and in which the proportion of the pulsating to nonpulsating streams can be varied at will.

In order to obtain the best utilization and efficiency, the instant invention aims to provide a spray nozzle operable to discharge a continuously coarse spray, a pulsating spray, a variable combination of the coarse spray and pulsating spray, a continuously fine spray and a variable combination of the fine spray and pulsating spray.

The spray nozzle according to the instant invention includes a slotted connecting plate having a connecting tube formed thereon, the connecting tube being provided with one or more holes through which flow is directed to discharge a continuously coarse spray out of a first group of discharge orifices via a first slot of the connecting plate. The connecting plate is further provided with a second slot for directing flow to discharge a continuously fine spray out of a second group of discharge orifices, and a third slot for directing flow into a spray cup assembly so as to drive a rotary valve member in rotation and therefore discharge a pulsating spray out of a third group of discharge orifices.

The spray nozzle according to the instant invention further provided with a flow directing plate having first, second and third slots formed thereon through which flow may be directed through three separate groups of discharge orifices to discharge a continuously coarse spray, a continuously fine spray and a pulsating spray respectively, or alternatively to discharge a combination of the pulsating spray and the coarse spray or fine spray.

These and other objects and advantages of the instant invention will become apparent by reference to the following specification and to the accompanying drawings.

DETAILED DESCRIPTION OF THE PREFERRED EMBODIMENT

Figure 1:
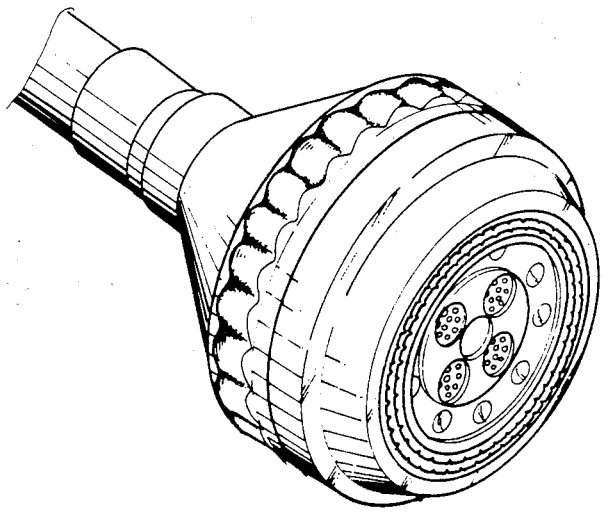
FIG. 1 is a perspective view of a showerhead embodying the instant invention and adapted for direct connection to a stationary supply pipe.
Figure 2:
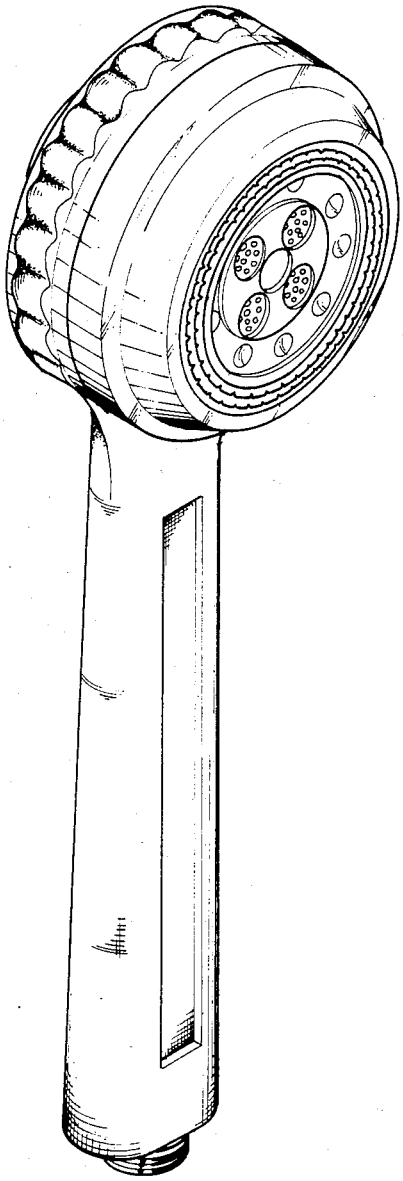
FIG. 2 is a perspective view of a modified form of showerhead adapted to be connected to the end of a flexible hose for use as a hand-held showerhead.

In the drawings, the instant invention is shown as being applied in FIG. 1 to a showerhead adapted to be mounted upon a stationary supply pipe and in FIG. 2 to a form of showerhead adapted to be attached to the end of a flexible hose or pipe to provide a hand-held showerhead. These two forms of showerheads differ primarily in the structure of their upper housing unit and connecting tube, but employ a common internal mechanism for regulation of the spray discharged from the respective unit. Unless specially stated to the contrary in the following description, it is to be assumed that the various parts and functions described below are applicable to either the wall-mounted unit of FIG. 1 or the hand-held unit of FIG. 2.

Figure 3:
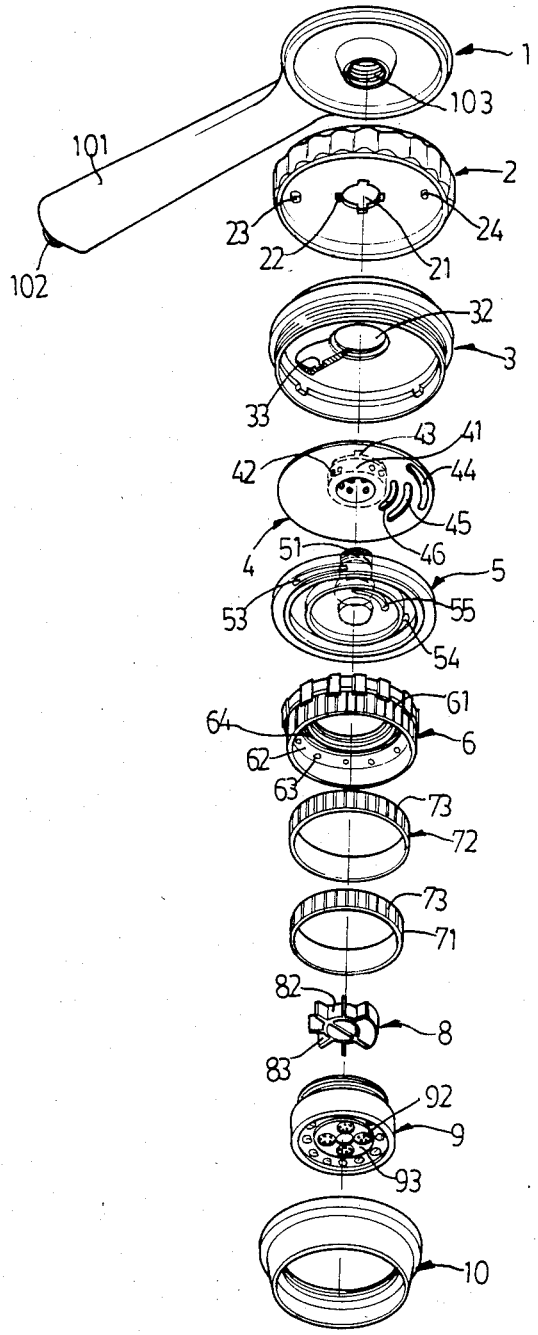
FIG. 3 is an exploded perspective view of the operating parts of the showerhead, these parts being common to the units of FIG. 1 and FIG. 2.
Figure 4:
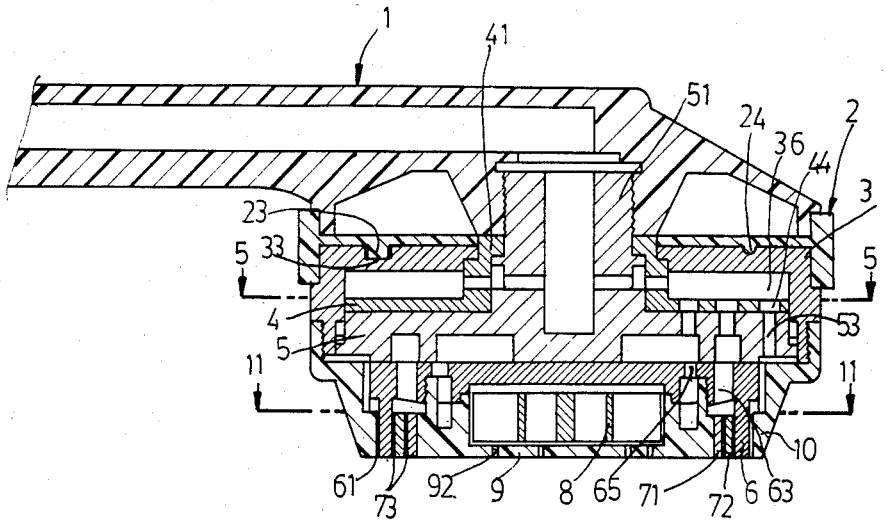
FIG. 4 is a cross-sectional view of the showerhead of FIG. 2 primarily taken on a central axial plane.
Figure 10:
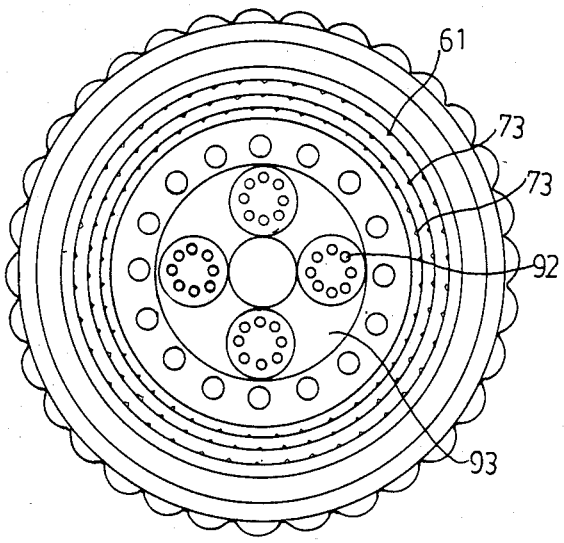
FIG. 10 is a bottom plan view of the showerhead of FIG. 1 or FIG. 2.
Figure 11:
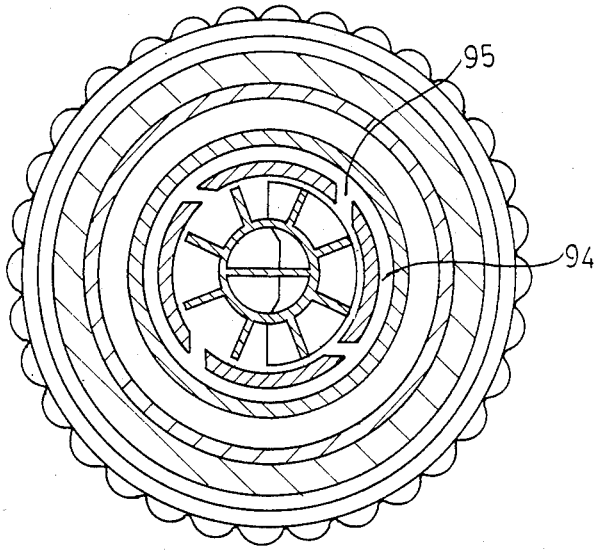
FIG. 11 is a detailed cross-sectional view taken on line 11—11 of FIG. 4.

Referring now to FIG. 3 and FIG. 4, a showerhead embodying the instant invention includes a lower housing unit (10) which has hollow tubular configuration and is threaded at its internal upper end. A spray cup assembly (9), as shown in FIGS. 3 and 11, is seated within the lower housing (10). Further, a first fine spray ring (71), a second fine spray ring (72) and a coarse spray unit (6) are also seated within the lower housing (10) between the spray cup assembly (9) and the wall of lower housing (10). The first and second fine spray rings (71,72) have external grooves (73) formed axially around the outer periphery thereof. The spray cup assembly (9) has an externally threaded neck at its upper end, and four groups of discharge orifices (92) are bored through end wall (93) of the spray cup (9), as shown in FIG. 10. A flow carrying trough (94) is extended around the circumference of the spray cup (9). As best seen in FIG. 11, a plurality of tangentially directed passages (95) pass through the radially inner wall of the trough (94) so that water flowing through the trough (94) is discharged tangentially into the central passage of spray cup (9).

As shown in FIGS. 3 and 4, the coarse spray unit (6), which is closed at its upper end, has grooves (61) formed axially on the outer periphery. Within the interior of the coarse spray unit (6) is formed a shoulder (62), in which a plurality of penetrating holes (63) function as water passages. Further, the coarse spray unit (6) also provides a trough (64) extended around the shoulder (62). The outer wall of the trough (64) has threads engageable with the externally threaded neck of the spray cup (9). A plurality of holes (65) are also formed in the trough (64) for functioning as other water passages.

A rotary valve member, designated generally (8), rests upon the inner or upper side of end wall (93) of the spray cup (9) and is retained by the inner wall of the trough (94) for rotation about the central axis of the unit. Valve member (8) is a one piece molded member preferably formed from a plastic material. The valve member (8) includes a cylindrical portion (82), and a flat generally C-shaped base plate portion which lies in a radical general plane and extends for approximately 180° about it central axis. A plurality of radially extending blades (83) are integrally mounted upon portions (82) in symmetrical relationship to the central axis of the unit.

A flow directing plate (4) is mounted over the upper side of a connecting plate (5) and is employed to direct and control the flow of water to the various discharge orifices. The connecting plate (5) includes a threaded connecting tube (51), on which a plurality of holes (52) are provided for passages of flow. The connecting plate (5) further provides with a first segmental slot (53), a second segmental slot (54) and a third segmental slot (55). The flow directing plate (4) includes a cylindrical tube (41), on which a plurality of holes (42) are provided for passages of flow and four lugs (43) are located at its upper end in diametrically opposed relationship to one another. The flow directing plate (4) is further provided with first, second and third slots (44, 45, 46) for directing flow to be discharged from various discharge orifices. The threaded connecting tube (51) of the connecting plate (5) passes through the cylindrical tube (41) of the flow directing plate (4) such that when the flow directing plate (4) is turned about its axis to a number of positions, the slots (44, 45, 46) can be aligned with and communicate directly with slots (53, 54, 55) of the connecting plate (5) respectively or simultaneously.

A flow adjusting plate (3) includes an externally threaded neck at its lower end for engaging with the lower housing unit (10). A central hole (32) is formed on the center of the flow adjusting plate (3). Further, the flow adjusting plate (3) also has a segmental groove (33) on its upper side, and five depressions (34) located in diametrically opposed relationship to the groove (33) for positioning and indicating the discharging states of flow.

A control ring assembly (2) includes a central hole (21) around which four notches (22) are formed in diametrically opposed relationship. The notches (22) are engageable with lugs (43) of the flow directing plate (4). The control ring assembly (2) further provides a lug (23) and a portrusion (24) which are disposed in diametrically opposed relationship. The lug (23) of the control ring assembly (2) is received in the groove (33) of the flow adjusting plate (3) and the protrusion (24) of the control ring assembly (2) is movable to be recessed in the depressions (34) of the flow adjusting plate (3).

An upper housing unit (1), as shown in FIG. 3, is adapted to be attached to the end of a flexible hose or pipe to provide a hand-held showerhead. However, a modification substantially providing the same structure can also be adapted to be mounted upon a stationary supply pipe to provide a wall-mounted showerhead. The upper housing unit (1) as shown in FIG. 3 includes a handle body (101), an inlet (102), and an outlet tube (103) which is threadably received upon the upper end of connecting tube (51) of the connecting plate (5).

The showerhead described above is operable to deliver five general types of sprays—a continuously coarse spray in which all water discharged from the showerhead is discharged in a continuous uninterrupted stream, a pulsating spray in which all water discharged from the showerhead is discharged in pulsating or cyclically interrupted streams, a combination continuous—pulsating spray in which a portion of the water is discharged in continuous streams while the remaining portion is discharged as a pulsating cyclically interrupted spray, a continuously fine spray and a combination of the fine spray and the pulsating spray.

Figure 5:
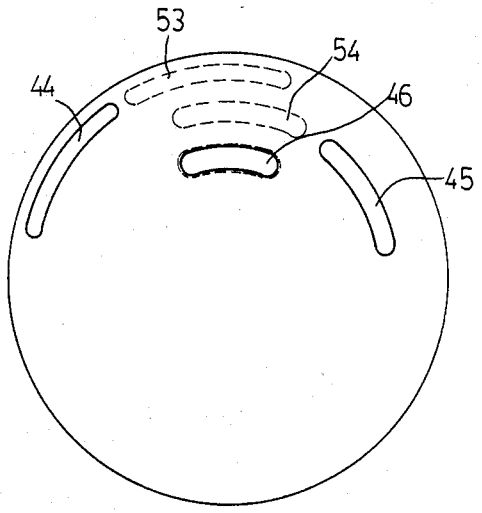
FIG. 5 is a schematic view taken on line 5—5 of FIG. 4 and showing the flow directing plate in midposition in its range of movement.

Referring to FIG. 4, it will be seen that water enters the showerhead through outlet (103) of the upper housing (1) and the connecting tube (51) of the connecting plate (5) and passes into an inlet chamber (36) enclosed by flow adjusting plate (3) and flow directing plate (4). The control ring assembly (2) is provided for controlling discharging of flow in a manner such that when the protrusion (24) thereof recessed in middle one of the five depressions (34) on the flow adjusting plate (3), the third slot (46) of flow directing plate (4) is aligned with the third slot (55) of the connecting plate (5), as shown in FIG. 5. In this event water may pass into flow carrying trough (94) of spray cup (9) through slots (46, 55) and holes (65), and therefore passes through tangential passages (95) into the interior of spray cup (9). Water then impinges on blades (83) of the rotary valve member (8) as the water is discharged from tangential passages (95), and thus drives rotary valve (8) in rotation to cyclically interrupt the streams of water discharged from orifices (92) to thereby discharge a pulsating spray.

Figure 6:
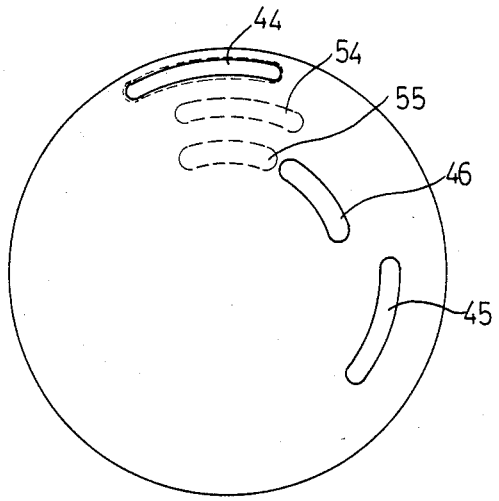
FIG. 6 is a view similar to FIG. 5, but showing the flow directing plate at one end limit of movement.
Figure 7:
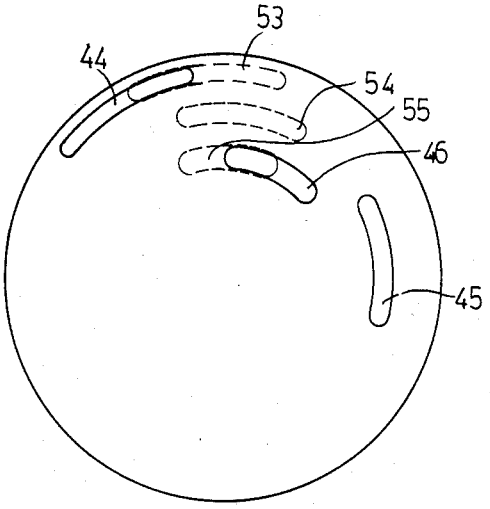
FIG. 7 is a view similar to FIG. 5, but showing the flow directing plate at the position between the end limit and the midposition of movement.
Figure 8:
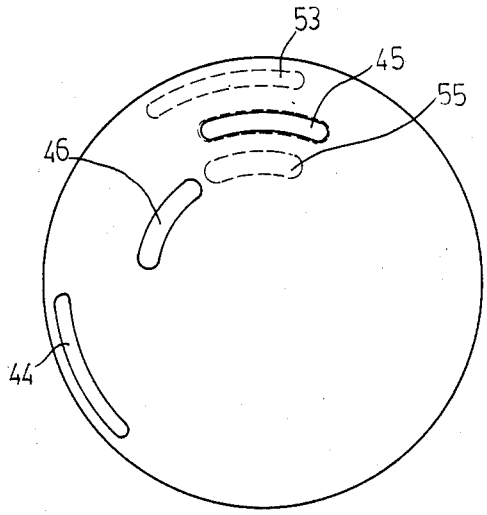
FIG. 8 is a view similar to FIG. 5, but showing the flow directing plate at the opposite end limit of movement from that shown in FIG. 6.
Figure 9:
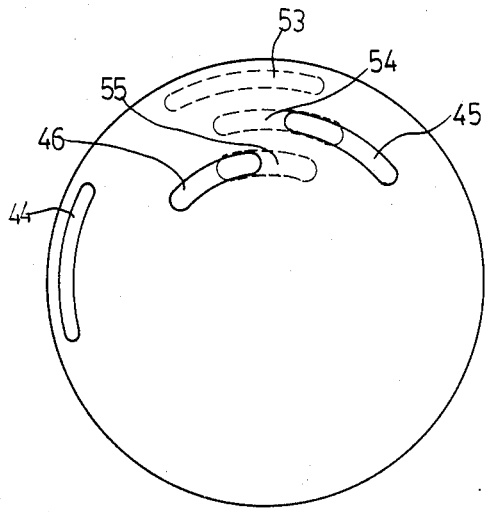
FIG. 9 is a view similar to FIG. 5, but showing the flow directing plate at the position between the midposition and the other end limit shown in FIG. 8 of movement.

In order to discharge a continuously coarse spray, the control ring assembly (2) is turned to a second position such that the first slot (44) of flow directing plate (4) is aligned with first slot (53) of the connecting plate (5) as shown in FIG. 6. In this event, water may discharge continuously a coarse spray from the external grooves (61) of coarse spray unit (6) through a first flow passage which is extended from slots (44, 53) through outer periphery of the coarse spray unit (6).

When the control ring assembly (2) is turned to a position between the midpoint of movement and said second position, the first and third slots (44, 46) of flow directing plate (4) are aligned partially with first and third slots (53, 55) of the connecting plate (5) respectively such that water may be discharged as a pulsating spray from the discharge orifices (92) of spray cup (9), and a continuous coarse spray from the external grooves (95) of coarse spray unit (9).

In order to discharge a continuous fine spray, the control ring assembly (2) is further turned to the opposite end of movement relative to said second position and in this event the second slot (45) of flow directing plate (4) is aligned with the second slot (54) of the connecting plate (5) such that water may discharge as a continuous fine spray from grooves (73) of the first and second fine spray rings (71, 72) through a second flow passage which is extended from slots (45, 54) through holes (63) of the coarse spray unit (6) and the outer periphery of first and second fine rings (71, 72).

Once the control ring assembly (2) is turned to a position between the midpoint of movement and said position operable to discharge a continuous fine spray, the second and third slots (45, 46) of flow directing plate (4) will be aligned with the second and third slots (54, 55) of connecting plate (5) such that water may be discharged as a pulsating spray from the discharge orifices (92) of spray cup (9), and a continuous fine spray from the external grooves (73) of first and second fine spray rings (71, 72).

It is noted that the terms "coarse spray" and "fine spray" mean that the stream diameter of the former is larger than that of the latter. Furthermore, the movement of the control ring assembly (2) is restrained rotationally by slideably recessing the lug (23) of the control ring assembly in the groove (33) of the flow adjusting plate (3). The five depressions (34) of the flow adjusting plate (3) are provided for receiving the protrusion (24) of the control ring assembly (2) during the movement of the control ring assembly (2) so as to indicating the discharging states of water.

While one embodiment of the invention has been described, it will be apparent to those skilled in the art that the described embodiment may be modified. Therefore, the foregoing description is to be considered exemplary rather than limiting, and the true scope of the instant invention is that defined in the following claims.

I claim:

1. A spray nozzle for selectively producing five kinds of sprays including a steady coarse spray, a fine spray, a pulsating spray, a combination of a coarse spray and a pulsating spray, and a combination of a fine spray and a pulsating spray, comprising:

a hollow housing having an inlet portion and an outlet portion;

directing means, disposed between said inlet portion and said outlet portion of said housing, for defining a first path for said coarse spray, a second path for said fine spray, and a third path for said pulsating spray;

control means, operably provided on said housing with five resting positions each corresponding to one of said five sprays for selectively causing one of the five sprays, for controlling the selection of said sprays;

characterized in that said directing means comprises two slotted plates, including a fixed plate fixed in said housing and a movable plate rotatably mounted in said housing;

said fixed plate having three slots including a first slot, a second slot, and a third slot substantially located at the respective circumferences of three concentric circles and extending a length along the circumferences; the center of the three circles being substantially at the geometrical center of said fixed plate; said fixed plate being sealingly mounted in said housing so that a fluid from the inlet portion can pass through said fixed plate to the outlet portion only through said slots; the position of said slots on said fixed plate being relatively close to one another so that the connecting lines connecting the middle point of each slot and the common center of the circles intersect with one another at one angle from 0 degree to a small sharp angle;

said movable plate being provided with a fourth slot, a fifth slot and a sixth slot, being sealingly mounted in said housing in close contact with said fixed plate, and being allowed to rotate in a plane closely attached to said fixed plate so that a fluid from the inlet portion can pass only through said fixed and movable plates to the outlet portion of the housing through the overlapping zones of the slots on the fixed plate and the slots on the movable plate; said movable plate being a flat round plate with its three slots located at the circumferences of three concentric circles corresponding to the first-mentioned three circles; all of said circles having centers located on the same vertical line perpendicular to the two plates, the common center of the second-mentioned three circles being the geometrical center of the movable plate; the sizes and shapes of the three slots of said movable plate being respectively correspondent to one each of the three slots of said fixed plate; the three slots of said movable plate being circumferentially spaced relatively far away from one another so that the connecting lines interconnecting the middle point of each slot and the common center of the second-mentioned circles intersect with one another at a relatively large angle;

said fourth, fifth, and sixth slots of said movable plate being respectively in communication with flows passing through said first, second and third slots of said fixed plate, said movable plate being in mechanical connection with said control means so that when the control means is in its first, second, third, fourth and fifth resting positions, respectively, the corresponding overlapping of the slots of the plates is as follows:

(a) only the first slot of the fixed plate and the fourth slot of the movable plate are substantially overlapping;

(b) only the fourth slot of the movable plate is partially overlapping with the first slot of the fixed plate, and the sixth slot of the movable plate is partially overlapping with the third slot of the fixed plate;

(c) only the third slot of the fixed plate and the sixth slot of the movable plate are substantially overlapping;

(d) only the fifth slot of the movable plate is partially overlapping with the second slot of the fixed plate, and the sixth slot of the movable plate is partially overlapping with the third slot of the fixed plate;

(e) only the second slot of the fixed plate and the fifth slot of the movable plate are substantially overlapping.

* * * * *